US012414595B1

(12) United States Patent
Nguyen

(10) Patent No.: US 12,414,595 B1
(45) Date of Patent: Sep. 16, 2025

(54) ARTIFICIAL EYELASH FAN

(71) Applicant: PLA Beauty, Inc., Reno, NV (US)

(72) Inventor: Thanh Nguyen, Reno, NV (US)

(73) Assignee: PLA Beauty, Inc., Reno, NV (US)

( * ) Notice: Subject to any disclaimer, the term of this patent is extended or adjusted under 35 U.S.C. 154(b) by 0 days.

(21) Appl. No.: 18/643,678

(22) Filed: Apr. 23, 2024

Related U.S. Application Data

(60) Provisional application No. 63/566,134, filed on Mar. 15, 2024.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | | |
|---|---|---|---|---|
| 3,833,007 | A | 9/1974 | Jacobs | |
| 6,935,348 | B2 | 8/2005 | Gold | |
| D632,018 | S | 2/2011 | Nguyen | |
| 8,113,218 | B2 | 2/2012 | Nguyen | |
| D670,031 | S | 10/2012 | Nguyen | |
| 9,125,468 | B2 * | 9/2015 | Pays | A41G 5/02 |
| 9,254,012 | B2 | 2/2016 | Pham | |
| 9,462,837 | B2 | 10/2016 | Ngo | |
| 9,565,883 | B2 * | 2/2017 | Dinh | A41G 5/02 |
| 10,660,388 | B2 | 5/2020 | Lotti | |
| 11,140,935 | B2 | 10/2021 | Ho | |
| 11,160,321 | B2 | 11/2021 | Zhang | |
| D969,408 | S | 11/2022 | Li | |
| D988,598 | S | 6/2023 | Zhang | |
| 11,832,669 | B2 | 12/2023 | Lotti | |
| D1,039,766 | S | 8/2024 | Lotti | |
| 2005/0061341 | A1 | 3/2005 | Choe | |

(Continued)

FOREIGN PATENT DOCUMENTS

| | | | |
|---|---|---|---|
| AU | 2017302022 | A1 | 9/2021 |
| CN | 211129854 | U | 7/2020 |

(Continued)

OTHER PUBLICATIONS

Ardell, "Ardell DuraLash Lashes", retrieved at https://www.walmart.com/ip/Ardell-DuraLash-Lashes-Flare-Short-Black/507696499 on Mar. 1, 2024.

(Continued)

*Primary Examiner* — Rachel R Steitz
(74) *Attorney, Agent, or Firm* — Brownstein Hyatt Farber Schreck, LLP

(57) ABSTRACT

An eyelash fan may include a plurality of hairs having a proximate end and a distal end. The plurality of hairs may be coupled together at a coupling region via an adhesive composition, heat fusion, or may be integrally formed. The coupling region is positioned at a distance from the proximate end such that the artificial hairs at the proximate end are not coupled or bound to each other. In this configuration, when the eyelash fan is applied to a single natural lash, the artificial hairs at the proximate end can wrap around the natural lash—thereby increasing the surface area and improving the wear time of the eyelash fan.

17 Claims, 13 Drawing Sheets

(56) References Cited

U.S. PATENT DOCUMENTS

| | | | | |
|---|---|---|---|---|
| 2014/0116460 | A1* | 5/2014 | McKinstry | A41G 5/02 132/216 |
| 2015/0114421 | A1 | 4/2015 | Pham | |
| 2015/0181967 | A1* | 7/2015 | Dinh | A41G 5/02 132/53 |
| 2015/0296914 | A1 | 10/2015 | Ngo | |
| 2017/0049173 | A1 | 2/2017 | Dinh | |
| 2018/0343948 | A1 | 12/2018 | Miller et al. | |
| 2018/0360148 | A1 | 12/2018 | Dinh | |
| 2021/0059339 | A1 | 3/2021 | Lee | |
| 2021/0161233 | A1* | 6/2021 | Lotti | A45D 44/00 |
| 2021/0274873 | A1 | 9/2021 | Zhang | |
| 2022/0225712 | A1 | 7/2022 | Byrne et al. | |
| 2023/0105622 | A1 | 4/2023 | Lotti | |
| 2023/0309638 | A1 | 10/2023 | Song | |

FOREIGN PATENT DOCUMENTS

| | | | |
|---|---|---|---|
| CN | 215775787 | U | 2/2022 |
| CN | 114532692 | A | 5/2022 |
| CN | 202230569600.5 | | 12/2022 |
| CN | 202230488692.4 | | 9/2023 |
| CZ | 26732 | U1 | 4/2014 |
| GB | 6147270 | | 7/2021 |
| IE | 2022/0063 | | 8/2022 |
| JP | 2020523210 | A | 8/2020 |
| KR | 20070107643 | A | 11/2007 |
| KR | 100915027 | B1 | 9/2009 |
| WO | WO2020078429 | | 4/2020 |
| WO | WO2023014668 | | 2/2023 |

OTHER PUBLICATIONS

Asako Ito, "Cluster Lashes: The Truth About Flares & Why They Are Bad", retrieved at https://divinelashes.ca/blog/cluster-lashes/ on Mar. 1, 2024.

i-Envy, "i-Envy Ultra Black Flare Long", retrieved at https://www.sallybeauty.com/cosmetics-and-skincare/makeup/eyelashes/i-envy-ultra-black-flare-long/SBS-019076.html on Mar. 1, 2024.

Kara Beauty, "Flare Long Synthetic Fiber Eyelashes", retrieved at https://karabeauty.com/products/kara-beauty-human-hair-eyelashes-flair-long?variant=1182008481&currency=USD&utm_medium=product_sync&utm_source=google&utm_content=sag_organic&utm_campaign=sag_organic&srsltid=AfmBOoqZebsJSqUt-UvARFywsCRDaDveZIXu1ThrvdbRNLRYfpcFb_uTWP4 on Mar. 1, 2024.

Lashbee Pro, "Everything You Need to Know About Pre-Made Volume Fans", retrieved at https://lashbeepro.com/blogs/news/everything-you-need-to-know-about-pre-made-volume-fans on Feb. 29, 2024.

Lashes BL, "How to Choose Premade Lash Fans", retrieved at https://www.bllashes.com/blogs/blog/how-to-choose-premade-lash-fans on Feb. 29, 2024.

Pawotence, "Pawotence Lash Extension Kit DIY", retrieved at https://www.amazon.com/Pawotence-Extension-Individual-Application-30D-0-07D-8-15MIX/dp/B0CBRL9PNK on Mar. 1, 2024.

Stacy Lash, "How Does the Shape of Fans Affect the Finished Look?", retrieved https://stacylash.com/blogs/lashing-materials/how-does-the-shape-of-fans-affect-the-finished-look at on Feb. 29, 2024.

Thousandlashes.com, "How to Apply Premade Lash Fans", retrieved at https://thousandlashes.biz/blogs/news/how-to-apply-premade-lash-fans on Feb. 29, 2024.

Vlash, "Vlash Flare Lashes, Long, 60 Pcs per Tray", retrieved at https://www.universalcompanies.com/products/vlash-flare-lashes-long-60-pcs-per-tray?variant=31455203557433&srsltid=AfmBOorZRwzWwwrcCoZQ29g3y7OVRO25ehFr2slmkKXuq5SEZBCrfaTcA4 on Mar. 1, 2024.

Wisp Lashes, "A Guide to Choosing the Best Pre-Made Lash Fan", retrieved at https://www.wisplashes.com/a-guide-to-choosing-the-best-pre-made-lash-fan/ on Feb. 29, 2024.

5D ProMade Loose Fans, Published on: unknown (online), Retrieved on: Sep. 4, 2024 (online), https://us.lashjungle.com/products/ 5d-loose-promade-fans-1000-premade-volume-lashes? (Year: 2024), 1 page.

Nagaraku Premade Fans Eyelash Extensions, Published on: Nov. 13, 2019 (online), Retrieved on: Sep. 4, 2024 (online), https://www.amazon.com/NAGARAKU-Extensions-Clusters-Beginner-Cruelty free/dp/B08GKFHGQS/ref=cm_cr_arp_d_ product_top?ie= UTF8 (Year: 2019), 1 page.

5D Loose Promade Fans, Published on: Sep. 18, 2021 (online), Retrieved on: Sep. 4, 2024 (online), https://us.lashjungle.com/products/ 5d-loose-promade-fans-1000-premade-volume-lashes? (Year: 2021), 2 pages.

5D Narrow Promade Fans, Published on: Oct. 25, 2023 (online), Retrieved on: Sep. 4, 2024 (online), https://us.lashjungle.com/products/ 5d-narrow-promade-fans-900-fans-noi r-col lection? (Year: 2023), 1 page.

* cited by examiner

ARTIFICIAL EYELASH FAN

TECHNICAL FIELD

Embodiments described herein relate to artificial eyelashes. In particular, embodiments described herein relate to an eyelash fans and methods of manufacturing.

BACKGROUND

Cosmetic products, such as artificial eyelashes, improve or enhance a wearer's appearance without invasive surgical treatments or other hormone-altering methods. Some traditional artificial eyelashes may be time-consuming to apply and may not achieve the user's expectations for longevity. The articles and methods of manufacturing described herein are directed to eyelash fans that may not have drawbacks associated with some traditional eyelash products.

SUMMARY

An eyelash fan, described herein, may be configured to be applied to a single natural lash of a wearer's upper eyelashes. The eyelash fan may include a plurality of artificial hairs having a proximate end and a distal end. The plurality of artificial hairs may define a fan. The eyelash fan may also include an adhesive composition binding the plurality of artificial hairs at a distance from the proximate end. Each artificial hair of the plurality of artificial hairs at the proximate end may be unbonded with respect to each other artificial hair and the plurality of artificial hairs at the proximate end may be configured to at least partially wrap around the single natural lash.

In some cases, the eyelash fan may be a first eyelash fan of a set of eyelash fans. Each eyelash fan of the set of eyelash fans may be attached to a different natural lash of the wearer's upper eyelashes and two or more eyelash fans of the set of eyelash fans may have a different length. The plurality of artificial hairs may include between 3 to 36 artificial hairs. In some examples, the plurality of artificial hairs includes 3 to 10 artificial hairs. The distance between the proximate end of the plurality of artificial hairs and the adhesive composition may be between 1 mm and 6 mm. The adhesive composition may extend along a bonding length ranging between 1 and 5 mm. A portion of the plurality of artificial hairs between the proximate end and the adhesive composition may be substantially free of adhesive. In some examples, each artificial hair of the plurality of artificial hairs may be between 0.01 mm to 0.25 mm in diameter. For example, each artificial hair may be between 0.03 mm and 0.07 mm in diameter. Each artificial hair of the plurality of artificial hairs may be formed from polybutylene terephthalate, polyethylene terephthalate, polyethylene isophthalate, polyamides, nylon, thermoset polymers, polycarbonate, polyesters, and the like. In some cases, the plurality of artificial hairs does not exceed 36 artificial hairs.

In some examples, a region of the eyelash fan having the adhesive composition defines the narrowest portion of the eyelash fan. In some cases, adhesive composition is visually transparent.

According to some embodiments described herein, an eyelash fan system may include an eyelash fan having a plurality of artificial hairs. The plurality of hairs may have a proximate end and a distal end, where the plurality of artificial hairs may widen from the proximate end towards the distal end. The eyelash fan may also include a first adhesive composition binding the plurality of artificial hairs at a distance from the proximate end, and a second adhesive composition applied to a natural eyelash of a wearer. In some cases, the second adhesive composition is applied to at least a portion of each artificial hairs of the plurality of artificial hairs at or near the proximate end and the at least a portion of each artificial hairs wraps circumferentially at least partially around the natural eyelash and couple to the natural eyelash via the second adhesive composition.

In some examples, each eyelash fan is configured to be positioned on one natural eyelash. In some cases, the first adhesive composition is cured prior to the eyelash fan being applied to the natural eyelash of the wearer. The distance of the first adhesive from the proximate end may be between 1 mm and 6 mm. In some cases, the second adhesive composition is an eye-safe adhesive applied in liquid form. Example eye-safe adhesives include ethyl-cyanoacrylate, other cyanoacrylate, formaldehyde-free adhesives, natural adhesive like starch-based or sugar-based adhesives, and other formulations that are save for use near a wearer's eye. The eyelash fan may be configured to be applied under the natural eyelash. In some cases, each artificial hair of the plurality of artificial hairs defines a curvature.

Embodiments described herein include a method of manufacturing an eyelash fan. The method may include: positioning, within a mold, a plurality of artificial hairs, the plurality of artificial hairs having at least three artificial hairs; rolling, over a curved member, the plurality of artificial hairs, the curved member having a predetermined curvature; baking the plurality of artificial hairs with the curved member, the baking applying heat to the plurality of artificial hairs such that a curvature for each artificial hairs is formed; and subsequent to baking, applying to a portion of the plurality of artificial hairs, an adhesive composition, the portion positioned a distance from a proximate end of the plurality of artificial hairs, each hair of the plurality of artificial hairs at the proximate end free from adhesive and configured to partially wrap around a natural eyelash of a wearer.

In some cases, the adhesive composition is applied at least 1 mm from the proximate end. The mold may be configured to hold a predetermined number of artificial hairs. The plurality of artificial hairs may be manually placed in the mold. The plurality of artificial hairs may define a distal end, the distal end having each artificial hair of the plurality of artificial hairs fanned out with respect to adjacent artificial hairs of the plurality of artificial hairs. The plurality of artificial hairs does not exceed 36 artificial hairs, in some examples.

An eyelash fan system described herein may include an eyelash fan having a plurality of artificial hairs having a proximate end and a distal end. The plurality of artificial hairs may widen from the proximate end towards the distal. The eyelash fan may also include a first adhesive composition binding the plurality of artificial hairs at a distance from the proximate end, and a second adhesive composition applied to a natural eyelash of a wearer. The second adhesive composition may be applied to at least a portion of each artificial hairs of the plurality of artificial hairs at the proximate end and the at least a portion of each artificial hairs may wrap at least partially around the natural eyelash and coupling to the natural eyelash via the second adhesive composition.

In some cases, the eyelash fan is a first eyelash fan of a set of eyelash fans and each eyelash fan of the set of eyelash fans is attached to a respective natural lash of the wearer's upper eyelashes. In other examples, the plurality of artificial hairs includes 3 to 36 hairs. For example, some eyelash fans may include 3 to 10 artificial hairs. The distance between the proximate end of the plurality of artificial hairs and the first adhesive composition may be between 1 mm and 6 mm. The eyelash fan may be configured to be applied under, on top, or on the sides of the natural eyelash. Each artificial hair of the plurality of artificial hairs may define a respective curvature with respect to the proximate end. In some embodiments, the first adhesive composition is positioned along a coupled region of the eyelash fan and the plurality of artificial hairs along a cross section of the coupled region are aligned in a single row.

In some examples, an eyelash fan is configured to be applied to a single natural lash of a wearer's natural eyelashes. The eyelash fan may include a plurality of artificial hairs having a proximate end of the eyelash fan and a distal end of the eyelash fan, the plurality of artificial hairs may define a fanned region. The eyelash fan may also include a coupling region positioned between the fanned region and the proximate end; the coupling region may bind the plurality of artificial hairs together at a distance from the proximate end. The eyelash fan may further include a base region extending from the coupling region to the proximate end, each artificial hair of the plurality of artificial hairs at the base region may be unbonded with respect to each other artificial hair, the plurality of artificial hairs at the base region are configured to at least partially wrap around the single natural lash.

In some cases, the eyelash fan is a first eyelash fan of a set of eyelash fans, each eyelash fan of the set of eyelash fans is attached to a different natural lash of the wearer's natural eyelashes, and two or more eyelash fans of the set of eyelash fans have a different length. In some examples, the plurality of artificial hairs may include 3 to 36 artificial hairs. For examples, an eyelash fan may have from 3 to 10 artificial hairs. The distance of the base region may be between 1 mm and 6 mm. The coupling region may include an adhesive composition extending longitudinally along the coupling region at a bonding length ranging between 1 and 5 mm. A portion of the plurality of artificial hairs at the base region may be substantially free of adhesive.

In some embodiments, each artificial hair of the plurality of artificial hairs is between 0.03 mm and 0.07 mm in diameter, and each artificial hair of the plurality of artificial hairs is formed from polybutylene terephthalate. In some examples, plurality of artificial hairs does not exceed 36 artificial hairs.

The eyelash fan may be a monolithic eyelash fan formed via a three-dimensional printing process. In some examples, the plurality of artificial hairs may be bonded at the coupling region via heat fusion.

BRIEF DESCRIPTION OF THE DRAWINGS

Reference will now be made to representative embodiments illustrated in the accompanying figures. It should be understood that the following descriptions are not intended to limit this disclosure to one included embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Figure 1A:
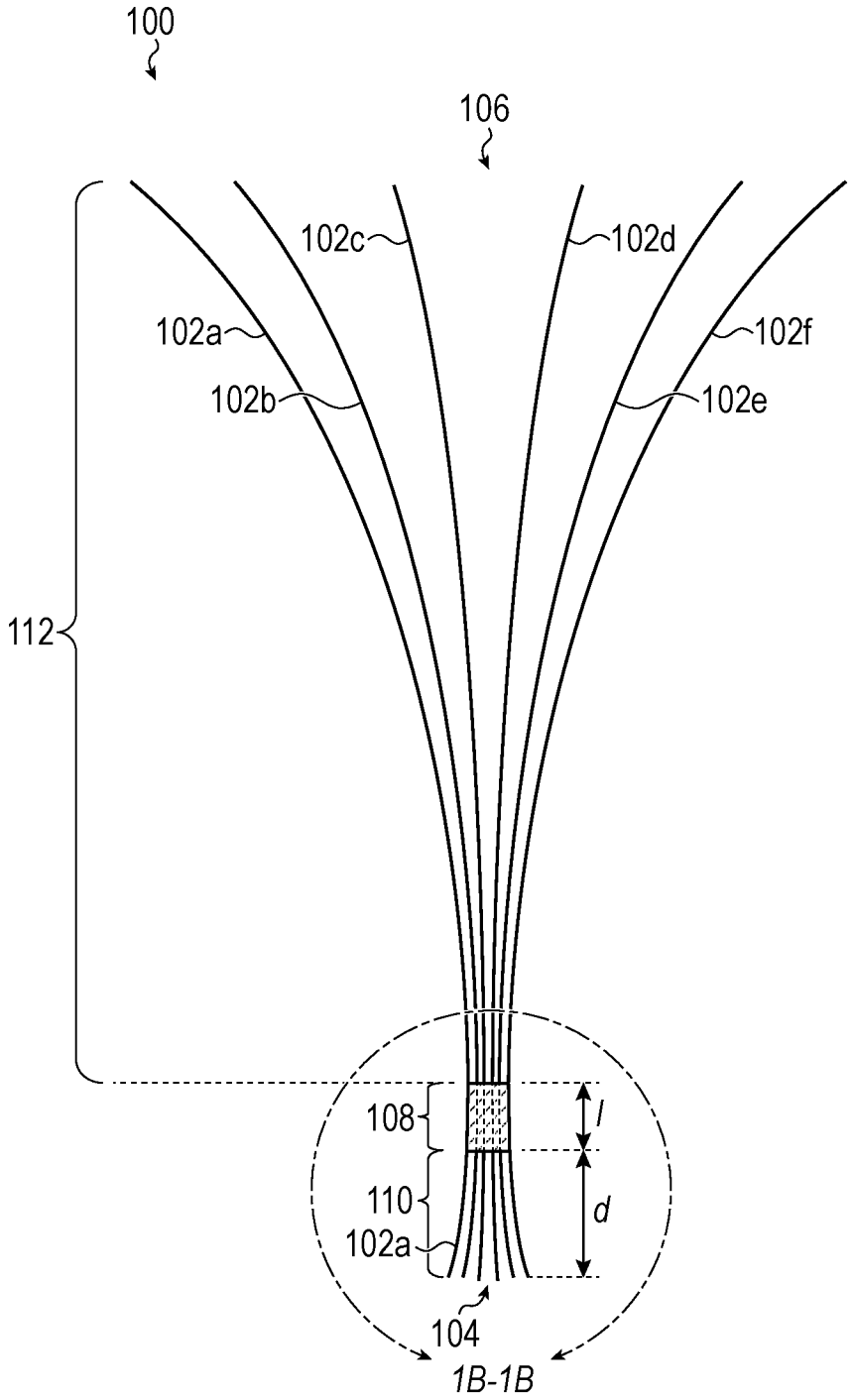
FIG. 1A depicts a top view of an example eyelash fan, such as described herein.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Embodiments described herein relate to eyelash fans. Specifically, the examples described herein are directed to pre-assembled eyelash fans that may be professionally-applied. The eyelash fans described herein are formed from a group of artificial lashes that are bonded or attached to each other at a location that is offset from an end of the group, resulting in a short portion of lashes at the end that are free of adhesive or other binding agent before the lashes are applied to a wearer. This short portion of lashes may be free to move and may splay slightly when the lash is attached to a wearer's or user's natural eyelash, which may result in an improved connection between the artificial eyelash fan and the user's natural lash.

Professionally-applied artificial eyelashes may be suitable for wearers that want long-lasting, full, and naturally-looking eyelashes without having to apply strip artificial eyelashes on a daily basis. Generally, to apply each artificial eyelash, a lash artist applies an adhesive composition to one end of an individual artificial hair. As described herein, application of the adhesive composition may be performed by immersing the end of the artificial eyelash into the adhesive composition, or the adhesive composition may be applied to the end of the artificial eyelash using a brush or other applicator. Application of the adhesive composition may also be referred to herein as "dousing" the end of the artificial eyelash, which includes a variety of application techniques. After the end of the artificial eyelash has been doused with the adhesive composition, the artificial eyelash is applied to an individual natural eyelash or group of natural eyelashes. To upkeep the eyelashes after application, wearers may have regular visits with the lash artist where new artificial hairs are applied to account for artificial hairs that have fallen off over time.

The disclosure described herein are directed to a group or plurality of eyelashes that may otherwise referred to herein as an eyelash fan. The group of eyelashes include multiple artificial lashes that are coupled together and can be applied at the same time (e.g., applied together to a single natural lash). They eyelash fan may be coupled to more than one natural lash but typically is applied as a series of eyelash fans to the wearer's upper or lower natural eyelash. Because the eyelash fan is configured for application to a single natural lash, the eyelash fan is distinct from full artificial lashes or what is sometimes referred to as segmented artificial lashes in which groups of clusters or artificial eyelashes are applied to a wearer as a connected group or set.

As described herein, the eyelash fan includes a structure that improves the connection between the artificial eyelash fan and the wearer's or user's natural eyelash. The eyelash fans described herein may improve the application time of professionally-applied eyelashes while also improving the wear time for the wearer and the upkeep. In particular, the eyelash fans described herein have a plurality of hairs, each having a proximal end and a distal end. The plurality of hairs are adhered between the proximal end and the distal end, at a first distance from the proximal end and at a second distance from the distal end, different from the first distance.

In some examples described herein, the artificial hairs at the proximal end of the eyelash fan (e.g., at the end that couples to the natural eyelash) are free from adhesive or other binding agent. Because the hairs at this proximal end are free from adhesive or other binding agent, each artificial hair portion at the proximal end is free to bend and/or move relative to the other artificial hairs. In other words, the artificial hairs are unconstrained with respect to each other at the proximal end of the eyelash fan. In this configuration, during the application process for the eyelash fan, the artificial hairs can wrap at least partially around the natural lash, thereby increasing the bonded surface area between the eyelash fan and the natural hair. By increasing the bonded surface area, the wear time of the eyelash fan increases.

The artificial hairs may be bonded or coupled together at a coupling region, which may be approximately 0.5 mm to 6 mm or greater from the end of the hairs. In some cases, the coupling region is 1 mm to 6 mm from the end. In some cases, the coupling region is 1 mm to 4 mm from the end. As described herein, the artificial hairs may be bonded using an adhesive in the coupling region and may be referred to as an adhered region or adhesion area. In other embodiments, the artificial hairs may by coupled using a melting or heat fusion process, which may also be referred to as an adhered region. In some cases, both heat and a bonding agent like a heat-activated or heat-cured adhesive are used in the coupling region. In yet other cases, the artificial hairs may be coupled using a bonding element, such as a sleeve, thread, or other element that at least partially surrounds the hairs in the coupling region. In some cases, the bonding element is a heat shrink sleeve or band, that wraps or otherwise binds the artificial hairs at the coupling region.

The coupling region may define the narrowest portion of the eyelash fan. From this region, the artificial hairs are splayed out outward (e.g., fan out with respect to the coupling region) to create a natural and full look. Due to its spacing with respect to the end, the hairs remain flexible enough to wrap around the natural hair yet the coupling region remains close to the waterline when the eyelash fan is applied. Thus, when applied, most of the weight of the eyelash fan is balanced with respect to the coupling region at or near the base of the natural lash and the coupling region is not easily perceivable by others. While the offset or distance from the proximal end to the coupling region may vary depending on the overall design of the eyelash fan, in some cases, the coupling region is offset from the proximal end of the group of lashes by 0.5 mm or greater. In some cases, the offset is 1 mm or greater. In some cases, the offset is 2 mm or greater. In some cases, the offset is 4 mm or greater.

These foregoing and other embodiments are discussed below with reference to FIGS. 1A-6. However, those skilled in the art will readily appreciate that the detailed description given herein with respect to these figures is for explanation only and should not be construed as limiting.

FIG. 1A shows a top or plan view of an eyelash fan. As described herein, an eyelash fan may refer to permanent and/or semi-permanent professionally-applied plurality of artificial hairs. The eyelash fans described here are applied to a single natural eyelash. An eyelash fan 100 may include a plurality of artificial hairs, such as artificial hairs 102*a-f*. In this example shown, the eyelash fan 100 has six artificial hairs (referred therein as a 6D fan). In some examples of the eyelash fan 100, the eyelash fan 100 may have anywhere from three artificial hairs (e.g., 3D) up to twenty artificial hairs (e.g., 20D). In some cases, the eyelash fan 100 may have as many as 36 artificial hairs (e.g., 36D). The 6D fan shown is meant for illustrative purpose and it is not limiting to a particular number of artificial hairs.

Further, while the artificial hairs 102*a-f* are shown having a similar length, the length of each artificial hair may vary depending on the intended volume and design of the eyelash fan. For example, some eyelash fans may include longer hairs in the middle of the fan to add more dimensions to the applied lash. In some embodiments, the artificial hairs may be made from a polymer like a polybutylene terephthalate (PBT), a polyamide (e.g., nylon), polypropylene, polycarbonates, polyesters, or other polymer material. The artificial hairs may also be made from a thermoset polymer or other similar material. In some examples, other materials may be used that include other polymer-based, synthetic or composite materials. While the hairs are referred to herein as "artificial" they may include naturally occurring materials including animal hairs, natural fibers, natural colors, oils, or other natural materials. While the examples depicted herein may appear to have a uniform thickness, lashes may have a tapered thickness or non-uniform thicknesses.

The eyelash fan 100 may have a plurality of artificial hairs 102*a-f* having an elongate shape. The eyelash fan 100 defines a proximate end 104 and a distal end 106. The proximate end 104 may be used to refer to the end of the eyelash fan which couples to or is configured to couple to the natural lash. The distal end 106 refers to the end of the eyelash fan, opposite the proximate end, where the artificial hairs are splayed out by the most distance. Put differently, the artificial hairs 102*a-f* diverge away from the proximate end and the eyelash fan 100 is at its widest at the distal end. The distal end 106 may be the end most visible by others when the eyelash is applied. Each artificial hair 102*a-f* extends contiguously from the proximate end 104 to the distal end 106.

The eyelash fan may include a coupling region 108 also referred to herein as a bonding region or adhesion region, crystalized portion, bonding location, or adhesive location. The coupling region 108 may be a portion of the eyelash fan where the artificial hairs 102*a-f* are coupled to one another using an adhesive, heat bonding process, coupling element or other technique used to bind or couple the hairs. The coupling region may include an adhesive portion having an adhesive composition that binds the artificial hairs 102*a-f*. The adhesive portion may be a cured adhesive which forms a solid yet flexible bond. For example, an adhesive composition may be applied in a liquid form and then cured to become solid. The adhesive composition may surround or at least partially encapsulate a portion of the artificial hairs and cures or solidifies to bond the artificial hairs 102*a-f* together. In some examples, the cured or solidified adhesive may be a crystalized material. In some embodiments, the adhesive composition is self-curing and does not require an application of heat to bond the artificial hairs together. In other examples, the adhesive composition may be powder coating, gel coating, or other type of adhesive. More generally, the adhesive refers to a permanent adhesive which keeps the artificial hairs 102*a-f* bonded during an application to the user. Thus, during application, the artificial hairs 102*a-f* are handled as a unit (e.g., the eyelash fan 100 unit) and maintain its coupling during and after application.

In some examples, the artificial hairs 102*a-f* are coupled together via heat fusion. For example, the artificial hairs 102*a-f* may be melted or partially melted to bond to each other at the coupling region 108 while leaving the hairs at the base region 110 unbonded. For example, the artificial hairs 102*a-f* may be partially fused together by applying heat to the coupling region. In some cases, the artificial hairs 102*a-f* may be pinched together to ensure coupling to each other. In some cases, a fusible thread, melted composite, or other binding material may be employed to bond the hairs together without requiring melting of the artificial hairs 102*a-f*. A heat-activated adhesive or other bonding agent may also be used alone or in combination with any of the coupling techniques described herein. In some cases, the artificial hairs 102*a-f* may be coupled together via a physical wrapping method. For example, a thread, film, band, shrink wrap, or other coupling element may be used to couple the artificial hairs at the coupling region 108.

In other examples, the eyelash fan 100 may be formed as a monolithic piece. For example, a three-dimensional printing process (e.g., micro 3D printing, microstereolithography, projection microstereolithography, two-photon polymerization, electrochemical deposition, or the like) may be used. In this process, the eyelash fan 100 may be formed in layers, in the order of nanometers or millimeters. A vat polymerization process, where a vat with photopolymer resin is used and a UV light cures the resin in layers may be used. In this configuration, the coupled region may be formed from the same material as the artificial hairs. As described above, the artificial hairs in the base region 110 may be unbonded with respect to each other, allowing the hair to wrap at least partially around the natural eyelash at the base. Due to the 3D printing process, a cross-section of the eyelash fan may be U-shaped, circular, flat, or the like to couple more seamlessly to the hair.

In some cases, the coupling region 108 may have a length measured along the length of the artificial hairs 102*a-f*. In some cases, the coupling region 108 is disposed over a small fraction of the lengths of the hair to reduce the added weight of the eyelash fan (e.g., from the adhesive composition or other bonding element). While use of an adhesive is described with respect to this and other examples provided herein, other bonding our coupling techniques may be used in combination with the adhesive or instead of the adhesive. In some examples, the coupling region is approximately 1 mm. More generally, the coupling region 108 is between 0.5 mm and 10 mm, between 1 mm and 8 mm, between 1 mm and 6 mm, between 1 mm and 5 mm, between 1 mm and 4 mm, between 1 mm and 3 mm.

An edge of the coupling region 108 may be positioned a distance "d" from the proximate end 104. In some embodiments, the distance "d" may be 0.5 mm, 1 mm, 1.5 mm, 2 mm, 3 mm, 4 mm, for example. In some cases, the distance "d" may range from 0.5-5 mm, 0.5-4 mm, 0.5-3 mm, 0.5-2 mm, 1-5 mm, 1-4 mm, 1-3 mm, 1-2 mm, as an example. In some examples, a length of the coupling region is less than a distance d and/or a length of a base region 110. For example, the ratio between the length of the coupling region 108 and the length of the base region may be 1/3, 1/2, 1/4, and the like. In some examples, the ratio between the length of the coupling region 108 and the length of the base region 110 may be 4:1, 3:1, 2:1, and the like.

The eyelash fan 100 may include a base region 110. As depicted in the figure, the base region 110 is a span (having the distance d) of artificial hairs 102*a-f* from the proximate end 104 to the coupling region 108. At the base region 110, the artificial hairs 102*a-f* are free of adhesive or other bonding agent. In this region, each of the artificial hair 102*a-f* are unconstrained at the proximate end 104 (and thus free to bend and/or move with respect to each other at this end). In some cases, the artificial hairs 102*a-f* at the base region 110 are cantilevered, with the unrestrained portion at the proximate end. In this configuration, a lash artist applying the eyelash fan can douse each of the artificial hairs 108*a-f* with an eye-safe adhesive and adapt them around the natural lash.

The term "free from adhesive," as used above, refers to artificial hairs which do not have adhesive or other bonding agent that couples or bonds each artificial hairs to adjacent artificial hairs. Thus the hairs remain relatively unconstrained with respect to each other at the proximate end 104 prior to application (e.g., as-shipped condition). As mentioned previously, the hairs may be free to move with respect to each other to allow the hairs to wrap at least partially around a wearer's or user's natural lash when being installed to improve the coupling of the artificial hairs with the wearer's natural lash. In some cases, the shipped eyelash fans may be placed over an adhesive strip which is removed prior to application.

The eyelash fan may also include a flared region 112. At the flared region 112, each of the artificial hairs 102*a-f* may progressively splay outward from the coupling region 108 towards the distal end 106. In this configuration, a width of the eyelash fan 100 may be at its widest at the distal end 106. Generally, at the flared region 112, the artificial hairs 102*a-f* are also free from the adhesive composition or other bonding agent from the coupling region.

Figure 1B:
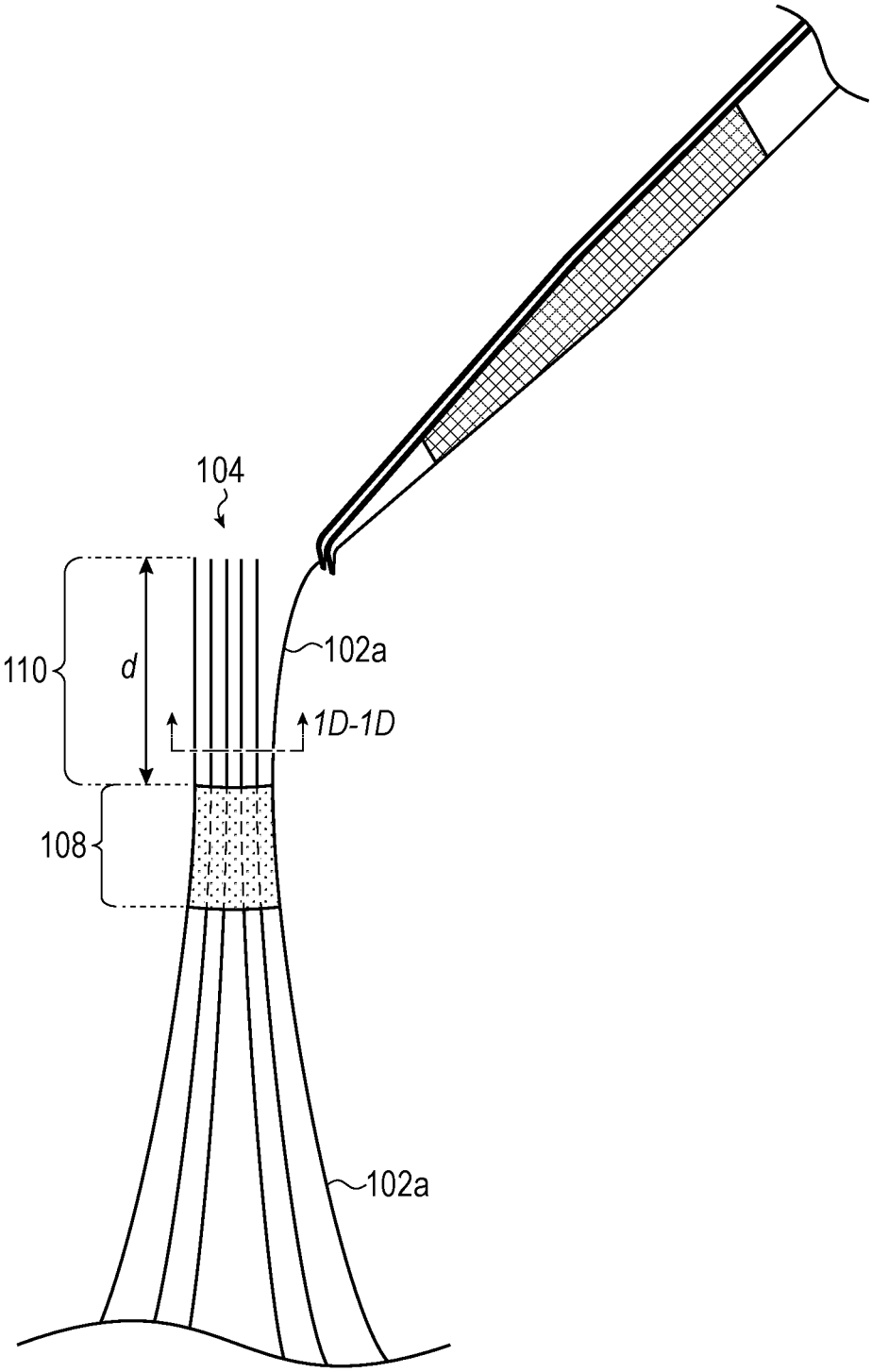
FIG. 1B depicts a detail view of the base region and the coupled region of an example eyelash fan, such as described herein.

FIG. 1B shows a detail view of the base region 110 and the coupling region 108. In some cases, as depicted, the artificial hairs along the base region 110 may be straight or substantially straight at this portion. However, because each artificial hair is substantively unconstrained with respect to each other artificial hair at the region, each artificial hair (e.g., 102*a*) may be separated from each other. For example, using a tweezer 114, a lash artist may separate the artificial hair to wrap the artificial hair 102*a* around the natural lash when applying the eyelash fan. Note that the tweezer shown in FIG. 1B is not necessarily drawn to scale with respect to the elements of the eyelash fan.

In some cases, as explained in more detail as to FIG. 4 below, the adhesive composition in the coupling region 108 may be applied to the artificial hairs after the artificial hairs have been curled. More specifically, each curled artificial hair may be grouped together to form the eyelash fan and then adhered once the configuration of the fan is set. By using this forming method, the adhesive composition may conform to at least a portion of the curvature of the artificial hairs.

Figure 1C:
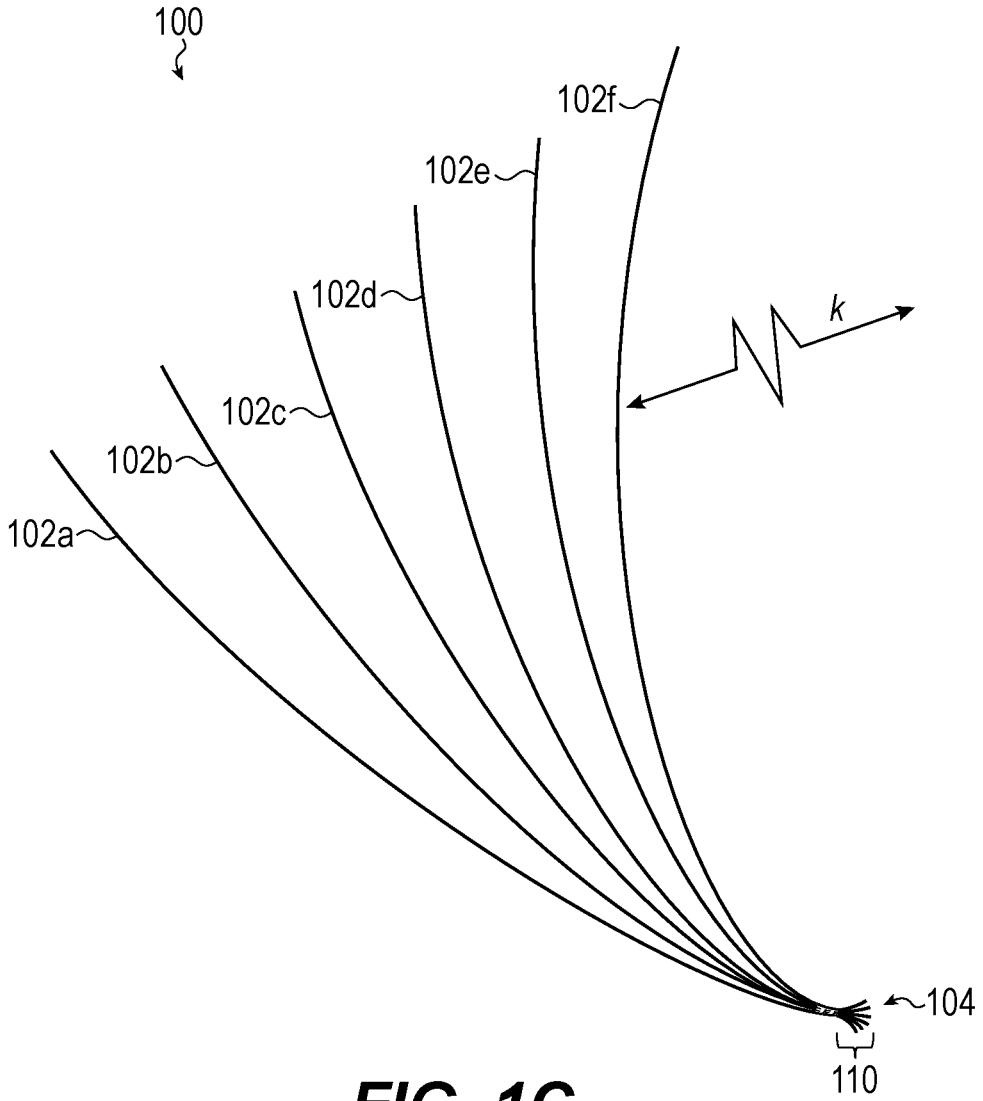
FIG. 1C depicts a side view of an example eyelash fan, such as described herein.

FIG. 1C shows an elevation or side view of the eyelash fan 100. This figure shows an example of how the artificial hairs 102*a-f* may be splayed with respect to each other at the base region 110 and shows an example of a lash curvature. As depicted, at the base region 110 the artificial hairs may have a flat or slightly curved configuration. This flat or slightly curved configuration allows the eyelash fan to couple to the natural hairs at or proximate to the lash line. Then, towards the distal end and at the flared region 112, the curvature of the hairs may progressively curve more further away from the proximate end. In some examples, each artificial hair 102*a-f* may have a respective curvature k. The curvature k defines the upward angle from the base of the eyelash that the hair takes. Generally, each artificial hair 102*a-f* has substantially the same curvature k. In some examples, however, the curvature k of each eyelash fan may be different to create a more unique lash. In some cases, the level of curvature may be designated by a letter. For example, eyelash curvatures may have designations of B, C, D, DD, and the like to indicate how much curvature each eyelash fan has.

Similarly, a thickness of the artificial hair 102*a-f* may vary. For example, artificial hairs may range from 0.01 mm to 0.07 mm, 0.03 mm to 0.05 mm, 0.02 mm to 0.1 mm, 0.03 mm to 0.06 mm, 0.03 to 0.07 mm, 0.03 to 0.12 mm, 0.03 mm to 0.15 mm, 0.03 mm to 0.20 mm, 0.03 mm to 0.25 mm, 0.01 mm to 0.25 mm, or 0.03 mm to 0.30 mm in diameter. The length of the artificial hairs 102*a-f* may also vary (e.g., length of the hair measures from the proximal end to the distal end). In some examples, the length of the hair may be from 3 mm to 30 mm. The combination of number of artificial hairs, curvature, thickness, and length may be based at least in part on a weight limit of the fan with respect to the natural eyelash of the wearer.

More generally, as depicted in FIGS. 1A and 1C, the eyelash fan 100 may splay or fan from the coupling region 108 in a lateral direction (e.g., horizontally with respect to the page in FIG. 1A) and vertically (e.g., up and down with respect to the page in FIG. 1C). In some embodiments, the coupling region 108 is the narrowest cross-section of the eyelash fan 100.

Figure 1D:
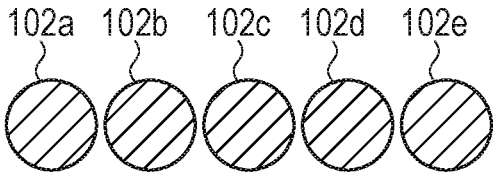
FIGS. 1D-1E depict a respective example cross-sectional views of the eyelash fan at the base region.
Figure 1E:
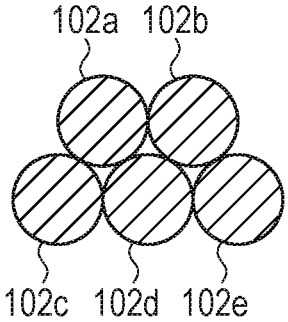

FIGS. 1D and 1E show an example cross-sectional view along line 1D-1D of the eyelash fan at the base region 110. FIG. 1D shows a first configuration of a cross section of the eyelash fan 100 where the artificial hairs are in a linear configuration. For example, the artificial hairs 102*a*-102*e* define a row of hairs aligned linearly. In this configuration, the linear arrangement may provide a lash artist or lash tech with a stable or flat surface to hold the eyelash fan during application. Because the artificial hairs 102*a*-102*e* at the base region 110 are not coupled to each other prior to applying the eyelash fan, when the eyelash fan is applied each of the artificial hairs 102*a*-102*e* can be wrapped around the natural eyelash and thereby couple to different portions of the natural eyelash (along a cross section, see FIG. 2C).

FIG. 1E shows a different configuration of a cross-section of the eyelash fan 100. In this configuration, the artificial hairs 102*a*-102*e* are stacked with respect to each other. Depending on the number of artificial hairs and the manufacturing method, the artificial hairs may be stacked to form a circular cross-section, a triangular cross-section, or other arrangement. In this example, the cross section of the eyelash fan 100 may be more compact, which may facilitate wrapping the artificial hairs 102*a*-102*e* around the natural eyelash.

Figure 2A:
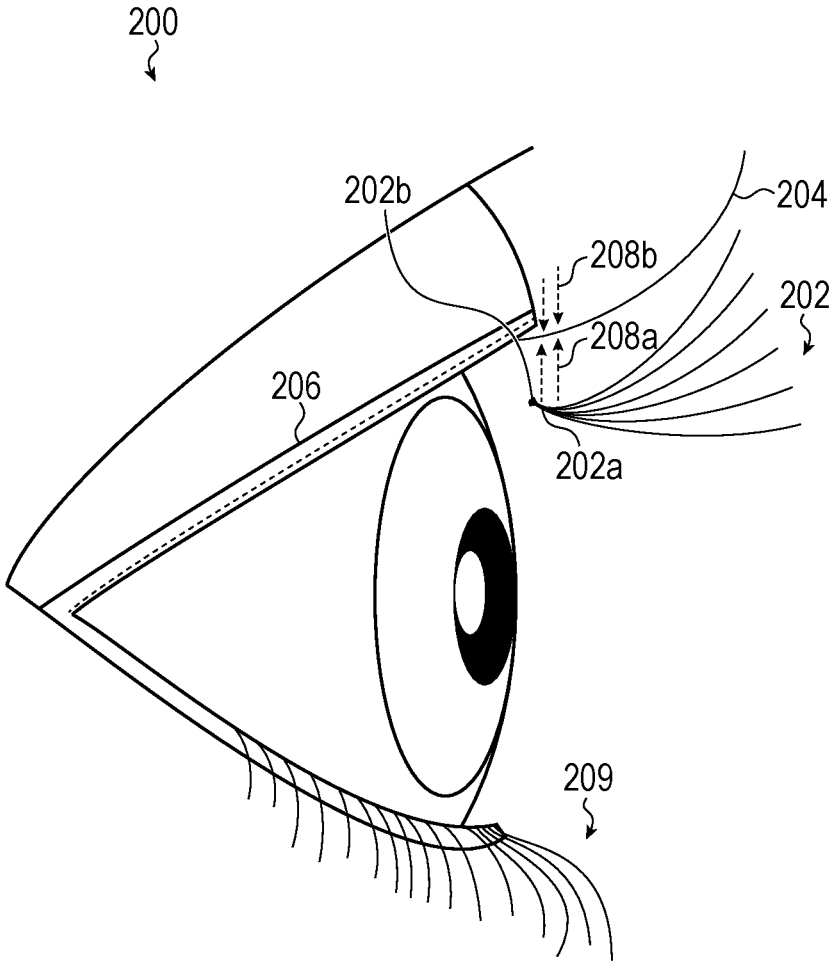
FIGS. 2A-2C depict an example application of an eyelash fan, such as described herein.
Figure 2B:
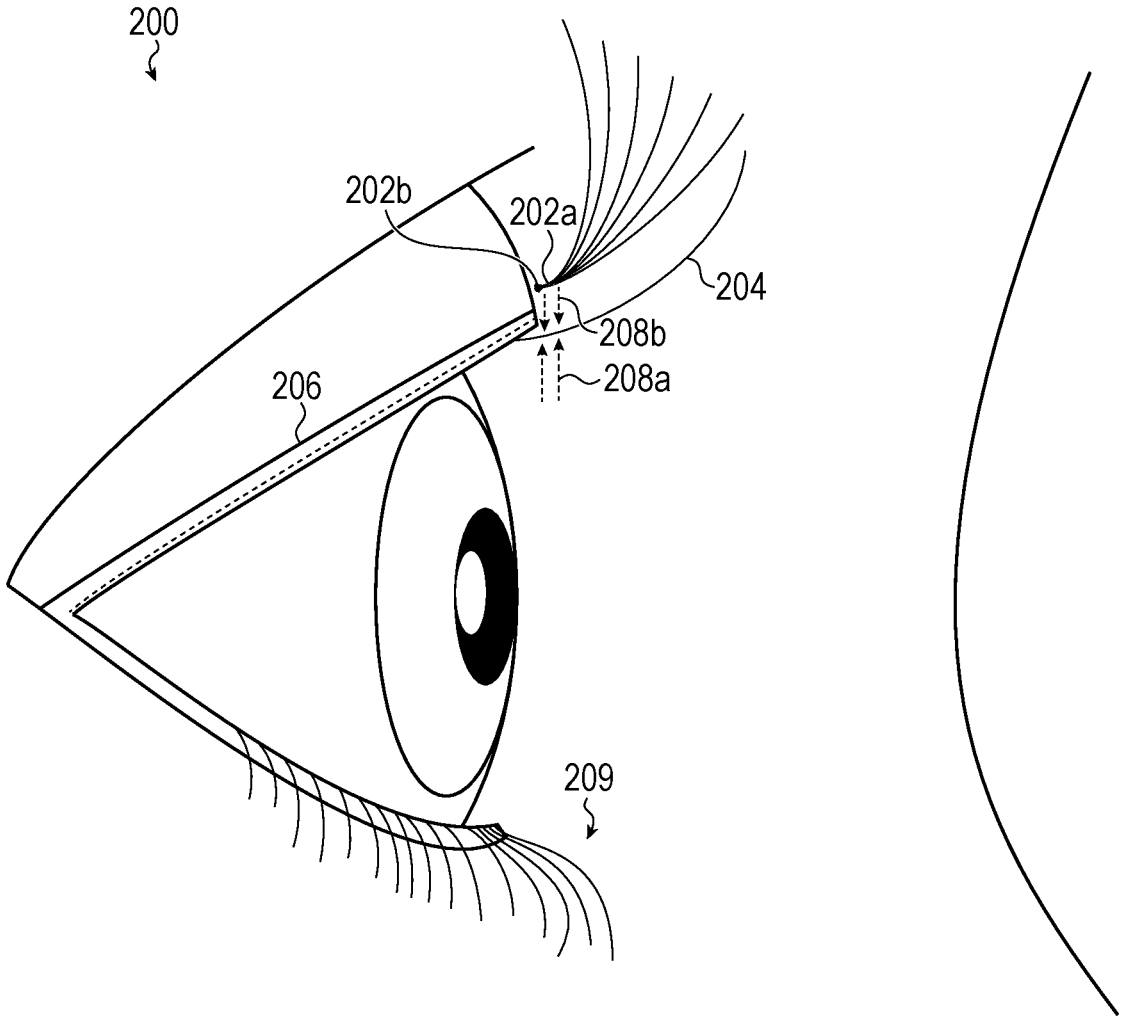

FIGS. 2A-2D depict an example application 200 of an eyelash fan. As depicted in FIG. 2A, an eyelash fan 202 may be applied to a single natural eyelash 204 of a wearer. To apply the eyelash fan 202, an eye-safe adhesive may be applied to the coupling region 202*a* and the base region 202*b*. In some cases, the eye-safe adhesive is used to coat an entirety of the coupling region 202*a* and the base region 202*b*. The eyelash fan 202 may then be applied with the base region 202*b* towards the waterline of the upper lash line 206. While FIG. 2A shows an eyelash fan applied to the upper lash line 206, FIG. 2B depicts the same methodology used to apply eyelash fans to the lower lash line 209.

In some examples, as depicted in FIG. 2A, the eyelash fan 202 is applied to the bottom of the natural lash (e.g., represented by arrow 208*a*). In some embodiments, as depicted in FIG. 2B, the eyelash fan 202 may be applied to the top of the natural lash (e.g., represented by arrow 208*b*). In some examples, the eyelash fan 202 may be applied to the sides of the natural lash.

The top, bottom, and/or side application of the eyelash fan 202 may be facilitated due to the artificial hairs at the base region 202*b* of the eyelash fan 202 being free from adhesive in the shipped condition (e.g., not coupled with respect to each other). To apply, a lash artist applies an eye-safe adhesive (e.g., douses the lashes) at the base region 202*b*, causing the adhesive to coat each artificial hair individually. Because the artificial hairs are not bonded together at region 202*b*, the artificial hairs can wrap at least partially around the natural lash 204. In the examples where the eyelash fan 202 is applied to the top, bottom, or side of the natural lash 204, the unbonded hairs at the base region 202*b* provides a larger surface area that can adhere to the natural lash. As compared to some eyelash clusters, where the eyelash cluster is bonded together at the base, the unbonded base of the eyelash fan 202 multiplies the natural lash-to-artificial hair contact area by the number of hairs. Generally, more surface area results in longer wear of the eyelash fans.

Figure 2C:
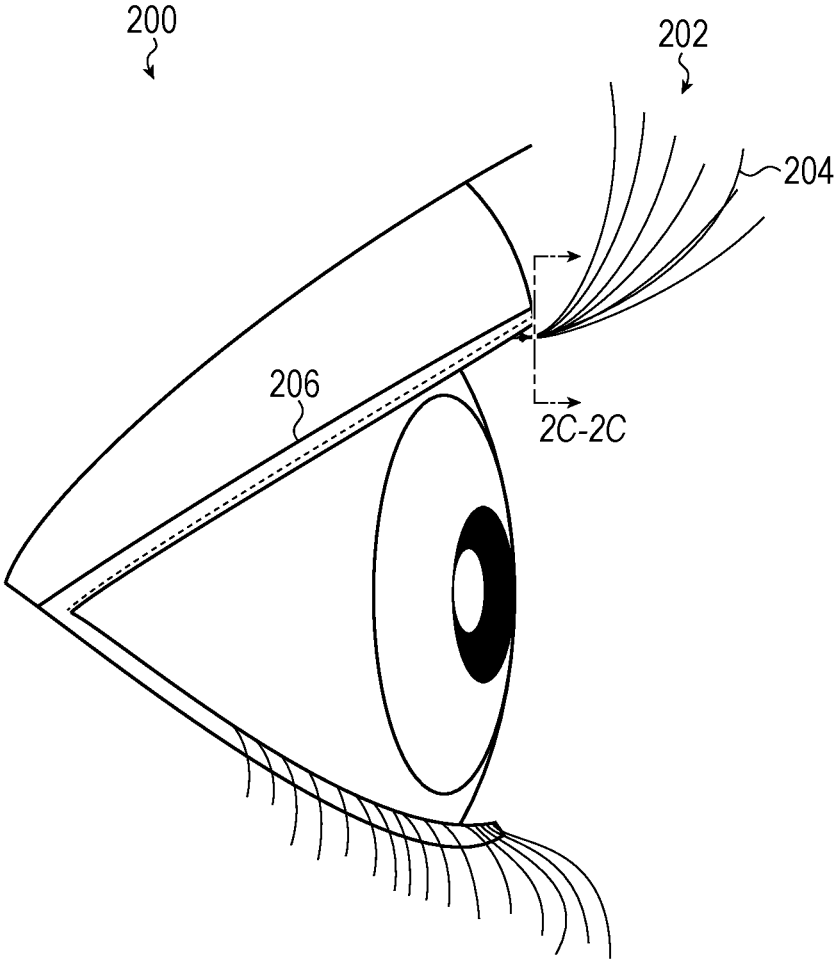

FIG. 2C shows the eyelash fan 202 once applied to the natural lash 204 of the wearer. The base region 202*b* of the eyelash fan 202 wraps around the natural lash 204 up until the coupling region 202*a*. At the coupling region 202*a*, the eyelash fan 202 sits over a portion of the natural lash 204 without wrapping. Due to the curl and length of each of the artificial hairs of the eyelash fan 202, each of the artificial hairs spreads around the natural lash 204 to create volume and to add length.

Figure 2D:
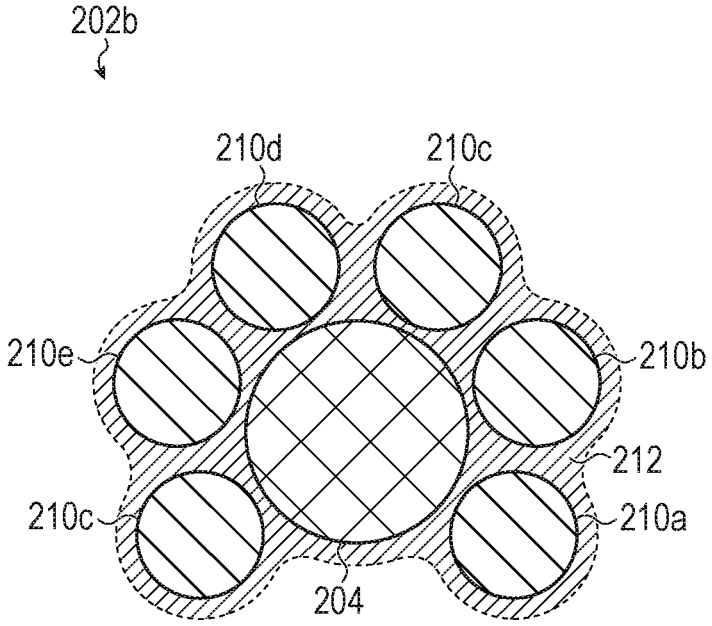
FIG. 2D depicts a cross-sectional view of an applied eyelash fan at the base region.

FIG. 2D shows a cross-sectional view of an applied eyelash fan 202 at the base region 202*b*. As shown in this illustrative example, each of the artificial hairs 210*a-f* (in this case of a 6D fan), is adhered to a portion of the natural hair 204 via an eye-safe adhesive 212. The eye-safe adhesive 212 covers a portion of the circumference of the natural hair 204 and of each of the artificial hairs 210*a-f*. The artificial hairs 210*a-f* are distributed along the circumference of the natural hair 204 (e.g., wraps around) to which distributes the bond area along the circumference times the length of the base region of the eyelash fan. In this configuration, even if an artificial hair 210*a* decouples from the natural lash 204, the remaining artificial hairs 210*a-f* maintain the bond, thereby extending the wear time of the eyelash fan 202. In some cases, particularly with eyelash fans having more artificial hairs, the artificial hairs may wrap around the natural lash and bond to each other and to the natural lash. While the example of FIG. 2D depicts a simplified or idealized cross section, depending on the application, the artificial hairs 210*a* may not be evenly distributed and some of the artificial hairs 210*a* may not be bonded directly to the natural hair 204, see FIG. 6.

Figure 3:
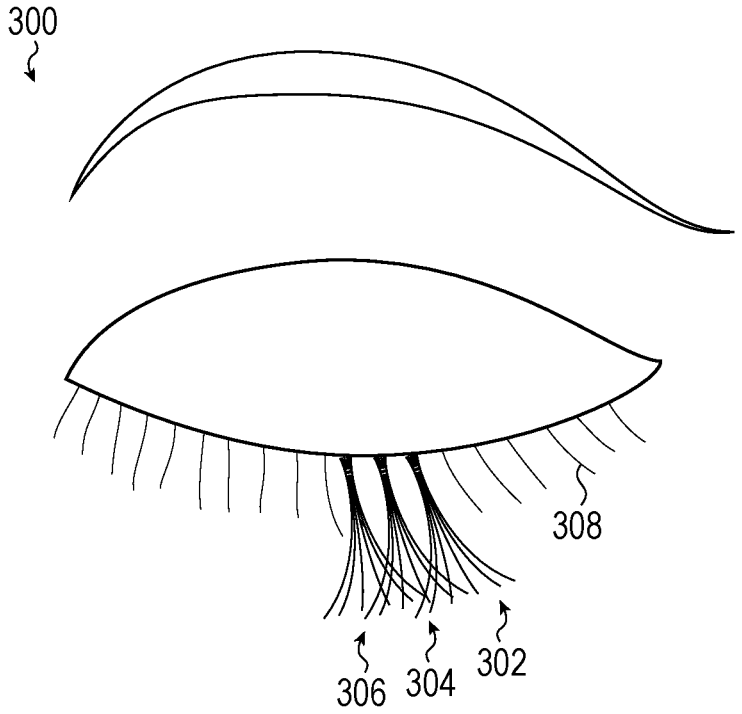
FIG. 3 depicts an example application of multiple eyelash fans applied to a lash of a wearer.

FIG. 3 depicts an example application 300 of multiple eyelash fans to the natural hairs of the upper lash line. As depicted, each eyelash fan 302, 304, and 306 are placed over single natural lash hairs 308. In some examples, each eyelash fan is positioned adjacent to each individual natural lash hair 308 such that at least some artificial hairs of the eyelash fans 302, 304, 306 overlap at the fanned region of the eyelash fan. This application method provides volume to the lash line and at least partially occludes the natural lash hair, such that the eyelash fan may look natural for the wearer. Again, the arrangement of FIG. 3 depicts a simplified or idealized application of the eyelash fans and, in practice, an eyelash fan may be bonded to two or more natural lashes or there may be lashes without an eyelash fan, depending on the style of the lash installation or the skill of the technician.

Figure 4:
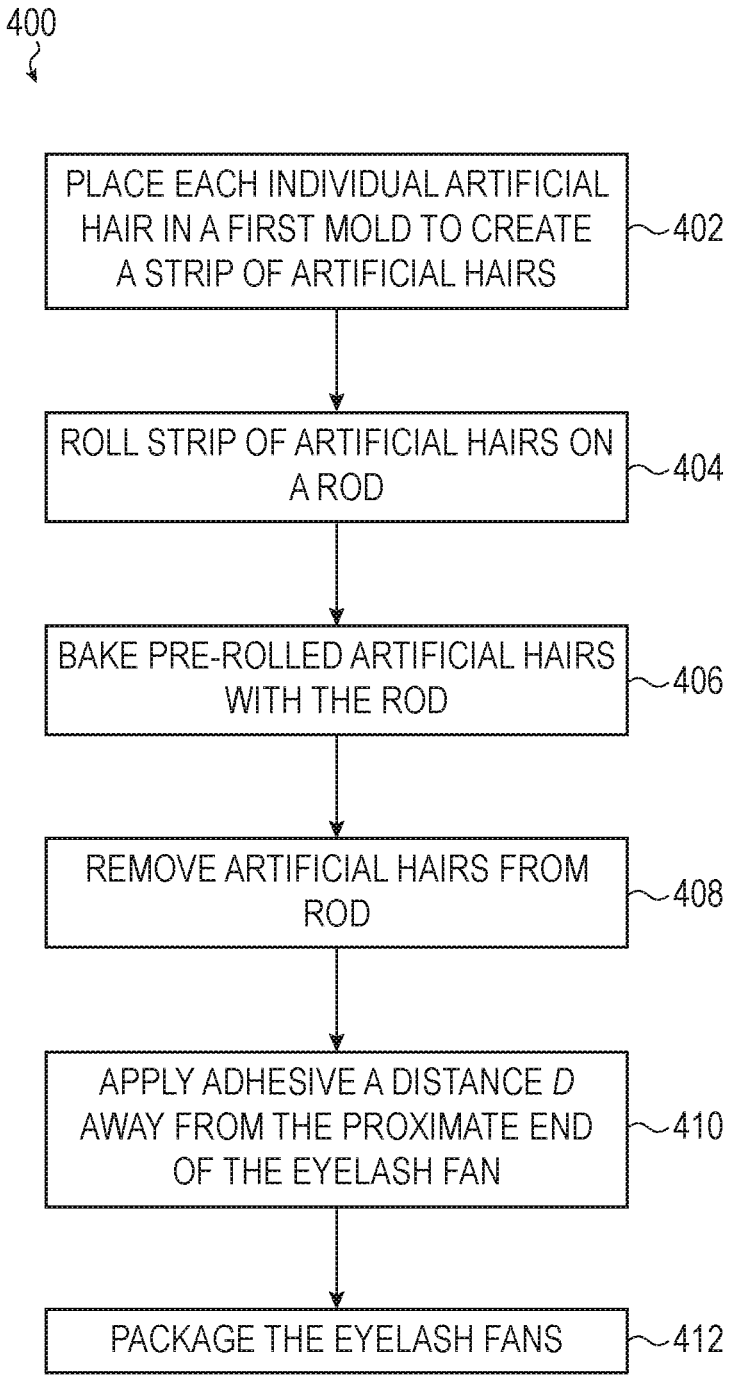
FIG. 4 depicts an example method for manufacturing an eyelash fan.

FIG. 4 shows an example manufacturing method 400 of an example eyelash fan. While the below method describes the process of making an example eyelash fan, the eyelash fan described as to FIGS. 1A-1C may be a premade eyelash fan with an adhesive placed at a distance d from a proximate end without heat bonding.

At step 402, artificial hairs may be placed in a mold. The artificial hairs (e.g., made from PBT or similar materials described herein) may be straight or uncurled artificial hairs. Some of the artificial hairs may have a pre-cut length for manufacturing. The mold may used may be specific to the dimension (e.g., 3D, 6D, 20D, 36D, and the like) of the final eyelash fan product. In some embodiments, the artificial hairs are measured and cut to approximately the final length of the eyelash fan. In some examples, the artificial hairs are placed in the mold by hand. Each mold may be aligned to create a strip of artificial hair groupings.

At step 404, the strip of artificial hairs (e.g., having 15, 30, or similar) number of eyelash fans are rolled at least partially around a cylindrical surface of a rod, drum, or other tool. More generally, the artificial hairs may be rolled in a heat-resistant piece that can help define the curvature of the artificial hairs. In some examples, the cylindrical tool may be formed from a metal material and include a diameter corresponding to the intended curvature of the final product.

At step 406, the cylindrical tool including the artificial hairs are heated during a baking process. The baking process may subject the artificial hairs to a temperature that allows for the polymer of the artificial hairs to be deformed without melting. In some cases, the temperature may range from 50 to 220 degrees Celsius. In some cases, the temperature range may be from 80 to 200 degrees Celsius. The baking process forms the curls and/or shape in each artificial hair. The application of heat (e.g., via the baking process) to the artificial hairs creates a permanent or long-lasting curl.

At step 408, the artificial hair groups are removed from the cylindrical tool. Each of the artificial hair groups may be aligned in trays and strips for quality control and for subsequent steps. At this step, the artificial hair groups may retain the general shape from the mold and from the baking process.

At step 410, an adhesive composition is applied to the groups of artificial hairs. The adhesive is applied at a distance d from the proximate end of each of the eyelash fan. In some embodiments, the adhesive may be applied with a brush or with other precision tools to ensure that the adhesive does not run to the end of the eyelash fan. In some embodiments, a protective sheet may be placed over the base portion of the eyelash fans to prevent adhesive from bonding the ends. In other examples, a second mold may be used to precisely align the location of the adhesive. Due to the quality control of this step, the adhesive portion (distance d) may be, for example, 1 mm or greater, 1.5 mm or greater, 2 mm or greater, 3 mm or greater, 4 mm or greater, and the like, from the proximate end. Unlike preassembled eyelash fan created by lash artists by hand, the method described herein reduces the amount of adhesive used, and thereby reducing the weight of the eyelash fan. Further, this technique prevents the issue of crystallization, where the end of the eyelash fan is bonded together, which, in turn, would prevent the preassembled eyelash fan from wrapping around a lash. Optionally, at this step, a technician may further form the eyelash fan by pinching the eyelash fan at the coupling region to reduce its cross-sectional area. The adhesive composition applied at the distance d may be allowed to solidify and/or cure.

As described as to FIG. 1B, while an adhesive composition is described, in some cases, the hair may be bonded via heat fusion or physical wrapping (e.g., shrink wrap, threads, staple, and the like).

At step 412, each eyelash fan is packaged for shipping. In some examples, the eyelash fans may be placed on a strip for shipping. The strip may include a glue that holds the eyelash fans together. Upon removing the eyelash fan from the strip, the artificial hairs at the proximate end are not bonded to each other (e.g., are free from adhesive).

The eyelash fans may then be bundled and shipped ready for lash artists to apply directly to the natural lash.

Figure 5A:
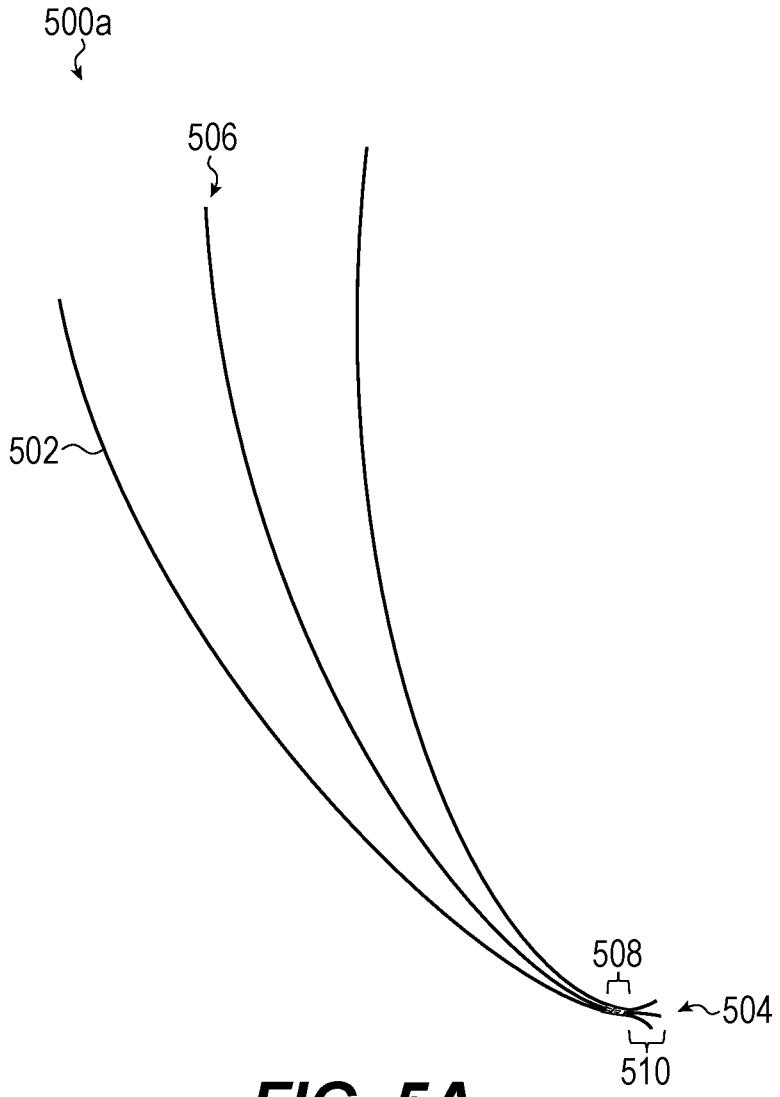
FIGS. 5A-5B depicts respective examples of an eyelash fan.

The above examples in FIGS. 1A-3 include an eyelash fan with six artificial hairs. However, as discussed above, the eyelash fan described in this disclosure may include a range of artificial hairs, generally from three artificial hairs and up to twenty artificial hairs. FIG. 5A shows an example eyelash fan 500*a* having three artificial hairs. For example, artificial hairs 502. As explained above, the eyelash fan 500*a* may have a coupling region 508 that includes an adhesive that bonds each of the artificial hairs relative to each other and a base region 510 being free from adhesive—where the artificial hairs 502 are not bonded with respect to each other (e.g., a distance d from a proximal end 504 of the eyelash fan). At a distal end 506, the artificial hairs 502 progressively curve upward and outward (e.g., widen and/or fan out), thereby adding volume to a wearer's lash line and providing a natural dramatic look.

Figure 5B:
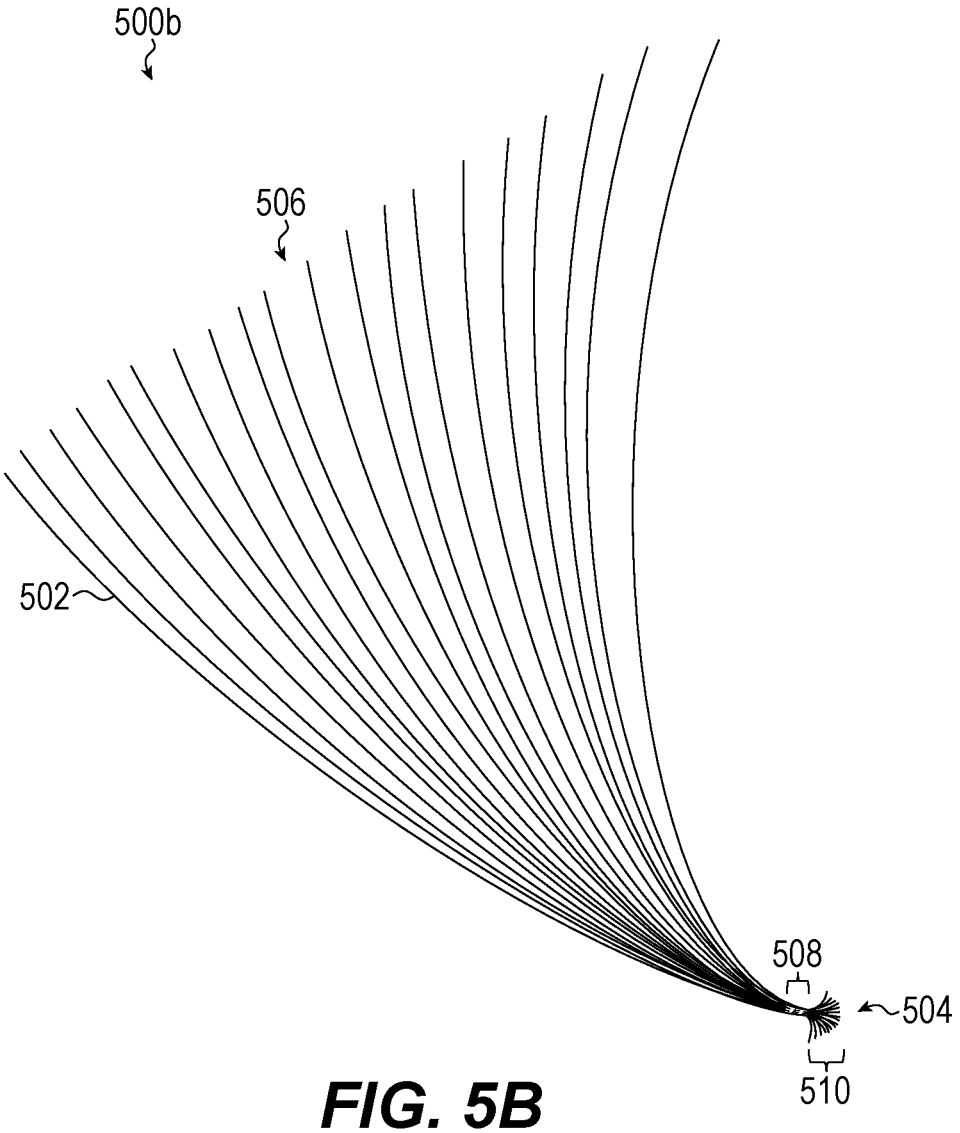

FIG. 5B shows another example eyelash fan 500*b* that can be adapted with the same features explained in FIGS. 1A-4 above. In this configuration, the eyelash fan 500*a* has twenty artificial lash hairs 502 which are not bonded together at the base region 510, thereby allowing each of the hairs to fan out and/or splay with respect to each other.

Figure 6:
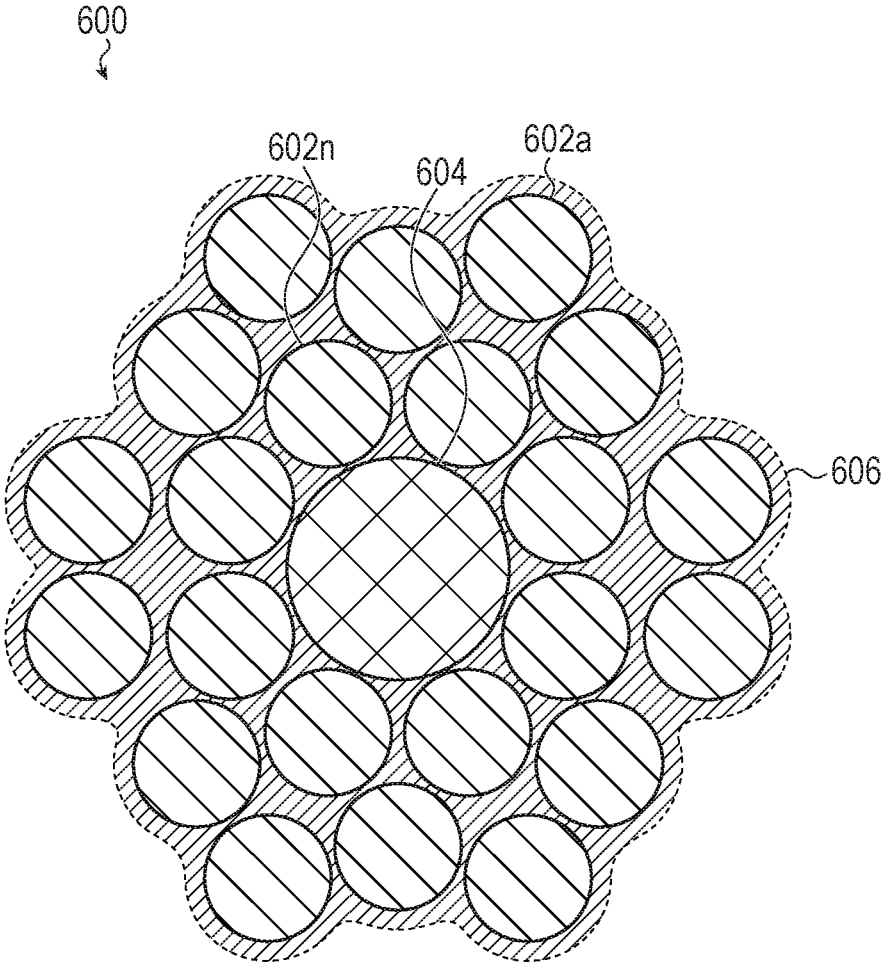
FIG. 6 depicts a cross-sectional view of an applied eyelash fan at the base region.

FIG. 6 shows a cross-sectional view 600 of the eyelash fan 500*b* applied to a natural eyelash 604. As depicted in this figure, each artificial hair 602*a-n* wraps around a portion of the natural eyelash 604 and/or around a portion of other artificial hairs 602*a-n*. Due to the number of artificial hairs and/or the thickness of each of the artificial hairs, the circumference of the natural eyelash 604 may be smaller than an adhesion area of the artificial hairs, causing the artificial hairs 602*a-n* to overlap with respect to each other. Despite the overlap, each individual artificial hair 602*a-n* can be efficiently distributed such to include the surface area of each artificial hair that is adhered (via the adhesive 606) to the natural eyelash.

As used herein, the phrase "at least one of" preceding a series of items, with the term "and" or "or" to separate any of the items, modifies the list as a whole, rather than each member of the list. The phrase "at least one of" does not require selection of at least one of each item listed; rather, the phrase allows a meaning that includes at a minimum one of any of the items, and/or at a minimum one of any combination of the items, and/or at a minimum one of each of the items. By way of example, the phrases "at least one of A, B, and C" or "at least one of A, B, or C" each refer to only A, only B, or only C; any combination of A, B, and C; and/or one or more of each of A, B, and C. Similarly, it may be appreciated that an order of elements presented for a conjunctive or disjunctive list provided herein should not be construed as limiting the disclosure to only that order provided.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the some embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. An eyelash fan system comprising:

an eyelash fan comprising:

a plurality of artificial hairs having a proximate end and a distal end, the first plurality of artificial hairs defining:

a base region at the proximate end and having a first length ranging between 1 mm and 6 mm, the plurality of artificial hairs unbonded with respect to other each artificial hair prior to being installed, the plurality of artificial hairs at the proximate end are stacked to define an approximately circular cross-section;

a coupling region adjacent to the base region and having a second length that is a ratio from 1:1 to 1:4 of the first length, the coupling region including a first adhesive composition that is cured to bind the plurality of artificial hairs throughout the coupling region; and a flared region adjacent to the coupling region and splaying outward from the coupling region, wherein:

the first length of the base region, the second length of the coupling region, and the circular cross-section are configured to cause the artificial hairs at the base region to wrap at least partially around a natural eyelash of a wearer when the eyelash fan is installed, and a second adhesive composition applied to the base region prior to attachment of the eyelash fan to the natural eyelash of the wearer, wherein:

the plurality of artificial hairs of the eyelash fan are unbonded with respect to other eyelash fans of the eyelash fan system prior to being installed.

2. The eyelash fan system of claim 1, wherein:

the eyelash fan is a first eyelash fan of a set of eyelash fans;

each eyelash fan of the set of eyelash fans are not attached to each other prior to being installed; and each eyelash fan of the set of eyelash fans are configured to be attached to a respective upper natural lash of the wearer.

3. The eyelash fan system of claim 1, wherein the plurality of artificial hairs includes 3 to 10 artificial hairs.

4. The eyelash fan system of claim 1, wherein the eyelash fan is configured to be applied over the natural eyelash.

5. The eyelash fan system of claim 1, wherein each artificial hair of the plurality of artificial hairs define a respective curvature with respect to the proximate end.

6. An eyelash fan configured to be applied to a single natural lash of a wearer's natural eyelashes, the eyelash fan comprising:

a plurality of artificial hairs defining a proximate end of the eyelash fan and a distal end of the eyelash fan, the plurality of artificial hairs defining a fanned region;

a base region at the proximate end and having a first length from 1 mm to 6 mm;

a coupling region positioned between the fanned region and the base region, the coupling region including a first adhesive that is cured to bind the plurality of artificial hairs together, the coupling region having a second length that is a ratio of 1:1 to 1:4 of the first length; and a second adhesive composition applied to the base region prior to attachment of the eyelash fan to a natural eyelash of a wearer wherein:

each artificial hair of the plurality of artificial hairs at the base region are unbonded with respect to each other artificial hair, the plurality of artificial hairs at the base region are stacked to define an approximately circular cross-section and are configured to at least partially wrap around the single natural lash.

7. The eyelash fan of claim 6, wherein:

the eyelash fan is a first eyelash fan of a set of eyelash fans;

each eyelash fan of the set of eyelash fans are configured to be attached to a different natural lash of the wearer's natural eyelashes; and two or more eyelash fans of the set of eyelash fans have a different length.

8. The eyelash fan of claim 6, wherein:

the plurality of artificial hairs includes 3 to 10 artificial hairs; and the coupling region comprises an adhesive composition extending longitudinally along the coupling region at a bonding length ranging between 1 and 5 mm.

9. The eyelash fan of claim 6, wherein:

each artificial hair of the plurality of artificial hairs is between 0.03 mm and 0.07 mm in diameter; and each artificial hair of the plurality of artificial hairs is formed from polybutylene terephthalate.

10. The eyelash fan of claim 6, wherein the plurality of artificial hairs does not exceed 36 artificial hairs.

11. The eyelash fan of claim 6, wherein the eyelash fan is a monolithic eyelash fan formed via a three-dimensional printing process.

12. The eyelash fan of claim 6, wherein the plurality of artificial hairs are bonded at the coupling region via heat fusion.

13. An eyelash fan system comprising:

an eyelash fan comprising:

a plurality of artificial hairs having a proximate end and a distal end, the plurality of artificial hairs defining:

a base region starting at the proximate end and having a first length between 1 mm and 6 mm;

a coupling region extending from the base region and having a second length that is a ratio of 1:1 to 1:4 of the first length, the coupling region comprising a first adhesive composition binding the plurality of artificial hairs;

a second adhesive composition applied to the base region prior to attachment of the eyelash fan to a natural eyelash of a wearer; and a flared region extending from the coupling region and widening toward the distal end, wherein:

the plurality of artificial hairs at the base region are arranged to define an approximately circular cross-section;

the plurality of artificial hairs at the base region are unbonded with respect to each other artificial hair by the first adhesive composition; and the first length of the base region, the second length of the coupling region and the circular cross-section are configured to cause the artificial hairs at the base region to wrap at least partially around a natural eyelash of a wearer when the eyelash fan when installed.

14. The eyelash fan system of claim 13, wherein the eyelash fan is configured to be positioned on one natural eyelash.

15. The eyelash fan system of claim 13, wherein the first adhesive composition is cured prior to the eyelash fan being applied to the natural eyelash of the wearer.

16. The eyelash fan system of claim 13, wherein the eyelash fan is configured to be applied under the natural eyelash.

17. The eyelash fan system of claim 13, wherein each artificial hair of the plurality of artificial hairs defines a curvature.

* * * * *